US008130152B2

(12) United States Patent
Kurashima et al.

(10) Patent No.: US 8,130,152 B2
(45) Date of Patent: Mar. 6, 2012

(54) ANTENNA APPARATUS

(75) Inventors: Shigemi Kurashima, Shinagawa (JP); Masahiro Yanagi, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 423 days.

(21) Appl. No.: 12/542,027

(22) Filed: Aug. 17, 2009

(65) Prior Publication Data

US 2010/0066632 A1 Mar. 18, 2010

(30) Foreign Application Priority Data

Sep. 12, 2008 (JP) ..... 2008-235020

(51) Int. Cl.
*H01Q 1/24* (2006.01)

(52) U.S. Cl. ..... 343/700 MS; 343/878

(58) Field of Classification Search ..... 343/700, 343/773, 878, 846
See application file for complete search history.

(56) References Cited

U.S. PATENT DOCUMENTS 2,505,751 A * 5/1950 Bolljahn ..... 343/708
2,514,020 A * 7/1950 Wehner ..... 343/848
6,806,839 B2 * 10/2004 Lo ..... 343/725

FOREIGN PATENT DOCUMENTS

JP 2004-129209 4/2004

* cited by examiner

*Primary Examiner* — Tho G Phan
(74) *Attorney, Agent, or Firm* — IPUSA, PLLC

(57) ABSTRACT

An antenna apparatus is disclosed that includes an antenna element having an inverted teardrop shape and configured to be fed with electrical power from an external power source; a ground element coupled to the antenna element; and a holding member configured to hold at least the top portion of the antenna element or a surface of a conical portion of the antenna element against the ground element.

5 Claims, 6 Drawing Sheets

ANTENNA APPARATUS

BACKGROUND OF THE INVENTION

1. Field of the Invention

The present invention relates to an antenna apparatus used in Ultra Wide Band (UWB) communication.

2. Description of the Related Art

UWB communication enables ultra fast communication by using a GHz frequency band. In 2002, the U.S. Federal Communication Commission (FCC) approved usage of the UWB. Since then, an application of the UWB to a portable electronic device and a high precision positioning system has been expected. An ultra wide frequency band antenna apparatus, which includes an inverted teardrop-shaped antenna element and is suitable for a GHz frequency band, has been developed.

Patent Document 1: Japanese Patent Laid-Open Publication No. 2004-129209

The inverted teardrop-shaped antenna element is connected to a ground element, and is insulated from the ground element.

Since a conical portion of the inverted teardrop-shaped antenna element is smaller than a hemispherical portion of the inverted teardrop-shaped antenna element, joint strength between the antenna element and the ground element may be insufficient.

SUMMARY OF THE INVENTION

It is a general object of the present invention to provide an antenna apparatus which has sufficient joint strength between an inverted teardrop-shaped antenna element and a ground element.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an antenna apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an antenna apparatus including an antenna element having an inverted teardrop shape and configured to be fed with electrical power from an external power source; a ground element coupled to the antenna element; and a holding member configured to hold at least the top portion of the antenna element or a surface of a conical portion of the antenna element against the ground element.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1A:
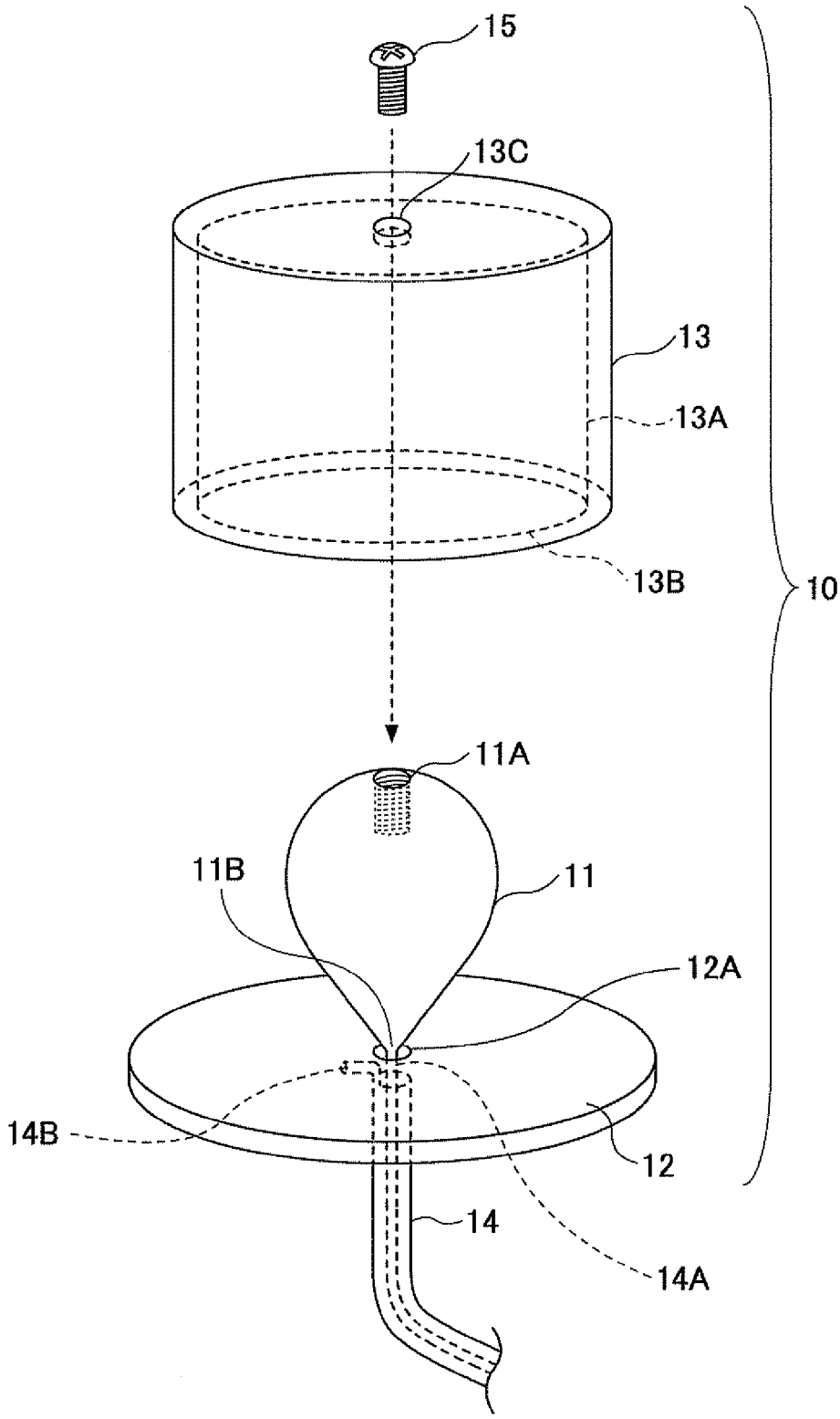
FIG. 1A is an exploded drawing of an antenna apparatus according to a first embodiment shown in perspective view.
Figure 1B:
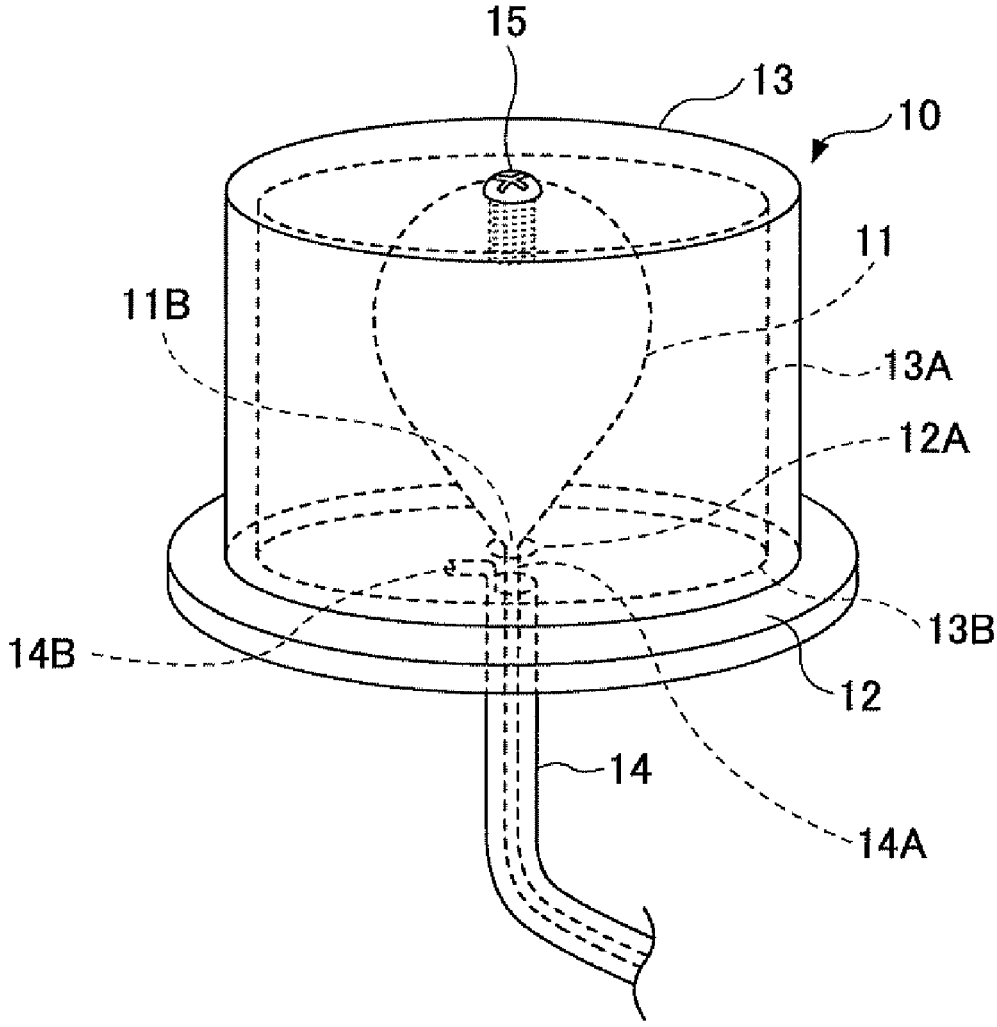
FIG. 1B is a schematic drawing of the antenna apparatus according to the first embodiment shown in perspective view.

FIG. 1A is an exploded drawing of an antenna apparatus according to a first embodiment shown in perspective view. FIG. 1B is a schematic drawing of the antenna apparatus according to the first embodiment shown in perspective view.

As shown in FIGS. 1A and 1B, an antenna apparatus 10 includes an antenna element 11 having an inverted teardrop shape, a ground element 12 having a disc shape, and a holder 13.

The antenna element 11 is made of, for example, an alloy such as an alloy including, for example, zinc, aluminum, magnesium, and copper, and formed by, for example, die casting.

The inverted teardrop shape of the antenna element 11 may be formed by engaging a hemispherical shape and a conical shape so that the hemispherical shape and the conical shape form a continuous outer surface of the inverted teardrop shape.

The antenna element 11 includes a threaded bore 11A formed on the top portion (the top portion of the hemispherical shape) which becomes a null point of the antenna element 11, and a feeding portion 11B which is formed at an apex of the conical shape. The threaded bore 11A constitutes an engaging bore.

A cable core 14A of a coaxial cable 14 is connected to the feeding portion 11B in order to feed electrical power thereto from an external power source (not shown).

The antenna element 11 is a quarter wavelength high from the upper surface of the ground element 12 to the top portion when assembled to the ground element 12. The quarter wavelength is determined by a communication frequency and dielectric constant of the holder 13, and is, for example, about 25 centimeters if the communication frequency is 3 GHz and the dielectric constant is 1.1.

The ground element 12 includes an opening 12A through which the cable core 14A of the coaxial cable 14 is connected to the feeding portion 11B in order to feed electrical power to the feeding portion 11B. A shielded line 14B of the coaxial cable 14 is connected to the back surface of the ground element 12. Thus, in the illustrated embodiment, the electrical potential of the ground element 12 is kept to the ground potential, and the ground element 12 is coupled to the antenna element 11.

Although the ground element 12 in FIG. 1 is shown as having a disc shape, the ground element 12 may be shaped in any shape in planar view, and the ground element 12 may be shaped to have any thickness.

The holder 13 is disposed on the ground element 12, and holds the antenna element 11 against the ground element 12 so as to cover the entire antenna element 11. The holder 13 constitutes a holding member. The holder 13 is formed of an inverted cylindrical cup shape, and made of an insulator such as a molded resin of which the dielectric constant is, for example, 1.1 as described above. The holder 13 includes an inner surface 13A having a cylindrical shape, an opening 13B which is formed in the bottom of the inverted cylindrical cup shape, and an opening 13C which is formed on the top surface of the inverted cylindrical cup shape, and through which a screw 15 is inserted and engaged into the threaded bore 11A.

The antenna element 11 and the holder 13 are engaged by threadably engaging the screw 15 into the threaded bore 11A through the opening 13C.

The screw 15 constitutes an engaging member, and is made of, for example, a resin. A portion of the screw which is threadably inserted into the threaded bore 11A may be made of metal.

The coaxial cable 14 may be formed of a shielded coaxial cable of which the characteristic impedance is 50Ω.

The holder 13 which is engaged with the antenna element 11 by the screw 15 is bonded onto the upper surface of the ground element 12 in order to form the antenna apparatus 10 as shown in FIG. 1B. The antenna element 11 is insulated from the ground element 12.

The antenna apparatus 10 including the antenna element 11 having the inverted teardrop shape as described above provides a VSWR (Voltage Standing Wave Ratio) value of about 2.0 to about 3.0 within the frequency band from about 3.0 GHz to about 20.0 GHz. The antenna apparatus 10 is suitable for UWB communication. The antenna apparatus 10 provides directivity which is uniform in 360 degrees, because the antenna apparatus 10 has a uniform shape in plane view. The antenna apparatus 10 provides high quality UWB communication.

Thus, the first embodiment of the present invention can provide the antenna apparatus 10 which is used in UWB communication with a high performance, and which can be assembled easily at a low cost, and provides sufficient joint strength between the antenna element 11 and the ground element 12.

Although the threaded bore 11A and the screw 15 in FIGS. 1A and 1B are shown, the antenna element 11 may be formed with a bore on the top portion thereof, and an engaging member such as a rivet may be inserted into the bore through the opening in order to engage the antenna element 11 and the ground element 12 with each other.

Although the antenna element 11 in FIGS. 1A and 1B is shown as made of alloy and formed by die casting, the antenna element 11 may be made of any material as long as the antenna element 11 includes a teardrop-shaped metal layer on its surface. For example, the antenna element 11 may be made of a molded teardrop-shaped resin of which the surface is metal plated.

Although the holder 13 as described above has a dielectric constant of 1.1, the dielectric constant may be varied to a value other than 1.1. If the dielectric constant of the antenna element 11 is higher than 1.1, the height of the antenna element 11 becomes smaller.

Second Embodiment

Figure 2A:
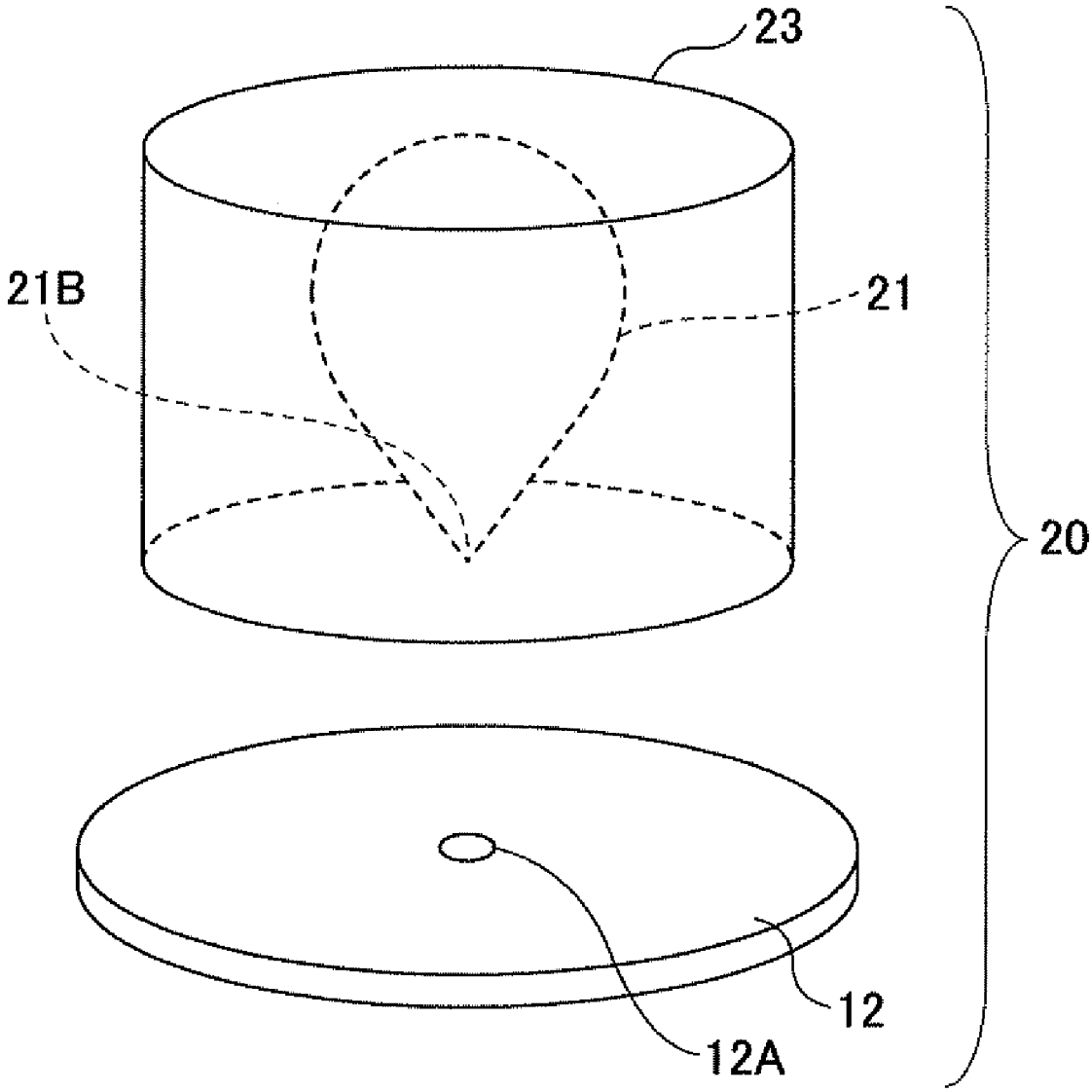
FIG. 2A is an exploded drawing of an antenna apparatus according to a second embodiment shown in perspective view.
Figure 2B:
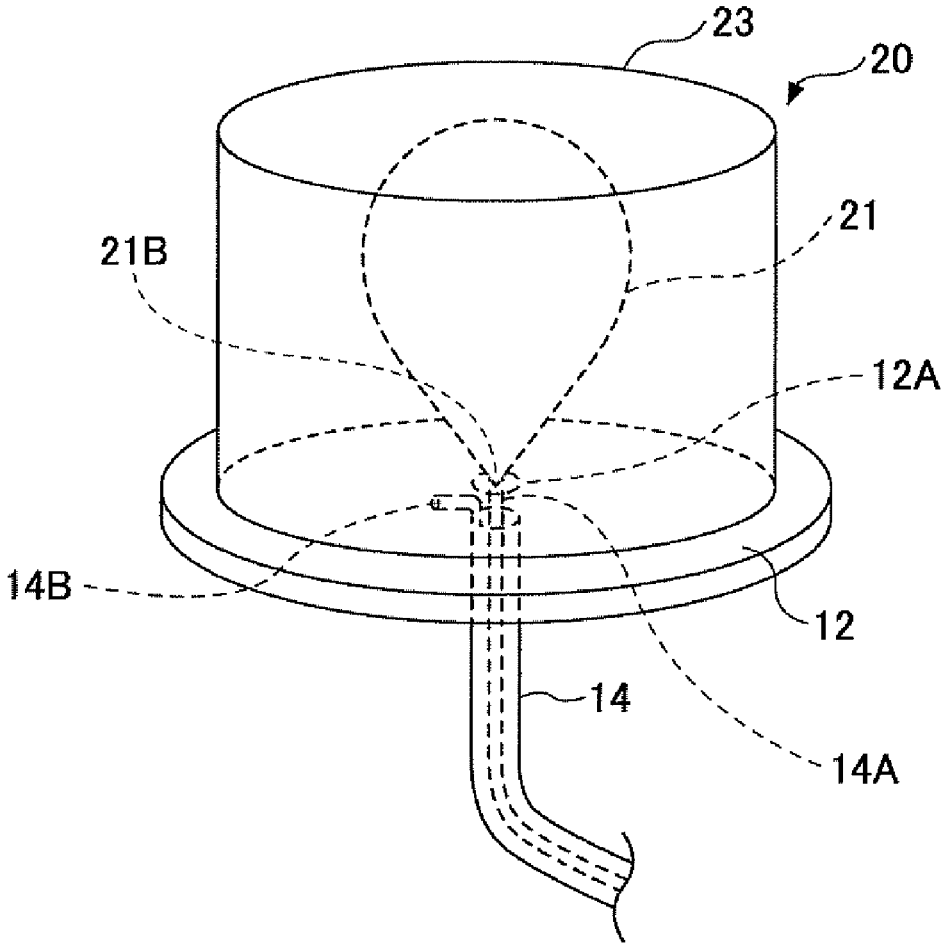
FIG. 2B is a schematic drawing of the antenna apparatus according to the second embodiment shown in perspective view.

FIG. 2A is an exploded drawing of an antenna apparatus according to a second embodiment shown in perspective view. FIG. 2B is a schematic drawing of the antenna apparatus according to the second embodiment shown in perspective view.

As shown in FIGS. 2A and 2B, the antenna apparatus 20 includes an antenna element 21 having an inverted teardrop shape, the ground element 12 having the disk shape, and a holder 23.

The antenna element 21 is different from the antenna element 11 according to the first embodiment in that the antenna element 21 does not include a threaded bore. The antenna element 21 includes a feeding portion 21B which is formed at an apex of the conical shape.

The holder 23 is different from the holder 13 according to the first embodiment in that the holder 23 is filled with resin which holds the surface of the antenna element 21 except for the feeding portion 21B, i.e. the holder 23 is not formed of an inverted cylindrical cup shape.

Hereinafter, the same elements as or similar elements to those of the antenna apparatus 10 according to the first embodiment are referred to by the same reference numerals, and a description thereof is omitted.

The holder 23 is bonded on the upper surface of the ground element 12 and holds the antenna element 21 against the ground element 12 as shown in FIG. 2B. The holder 23 constitutes a holding member. The holder 23 is formed of molded resin, and is formed so that the holder 23 includes the antenna element 21 except for the feeding portion 21B, and so that the holder 23 is shaped into the cylindrical shape. The holder 23 may be made of a transparent resin such as PEA (Tetra fluoro ethylene-perfluoro alkylvinyl ether copolymer) or FEP (Tetra fluoro ethylene-hexafluoro propylene).

As shown in FIG. 2B, the antenna apparatus 20 is assembled by bonding the holder 23 onto the upper surface of the ground element 12 in a state the cable core 14A is connected to the feeding portion 21B via the opening 12A. The antenna element 21 is insulated from the ground element 12.

The antenna apparatus 20 including the antenna element 21 having the inverted teardrop shape as described above provides a VSWR value of about 2.0 to about 3.0 within the frequency band from about 3.0 GHz to about 20.0 GHz. The antenna apparatus 20 is suitable for UWB communication. The antenna apparatus 20 provides directivity which is uniform in 360 degrees, because the antenna apparatus 20 has a uniform shape in plane view. The antenna apparatus 20 provides high quality UWB communication.

Thus, the second embodiment of the present invention can provide the antenna apparatus 20 which is used in UWB communication with a high performance, and which can be assembled easily at a low cost, and which provides sufficient joint strength between the antenna element 21 and the ground element 12.

Although the antenna element 21 in FIGS. 2A and 2B is shown as made of alloy and formed by die casting, the antenna element 21 may be made of any material as long as the antenna element 21 includes a teardrop-shaped metal layer on its surface. For example, the antenna element 21 may be made of a molded teardrop-shaped resin of which the surface is metal plated.

Although the holder 23 as described above has a dielectric constant of 1.1, the dielectric constant may be varied to a value other than 1.1. If the dielectric constant of the antenna element 21 is higher than 1.1, the height of the antenna element 21 becomes smaller.

Third Embodiment

Figure 3A:
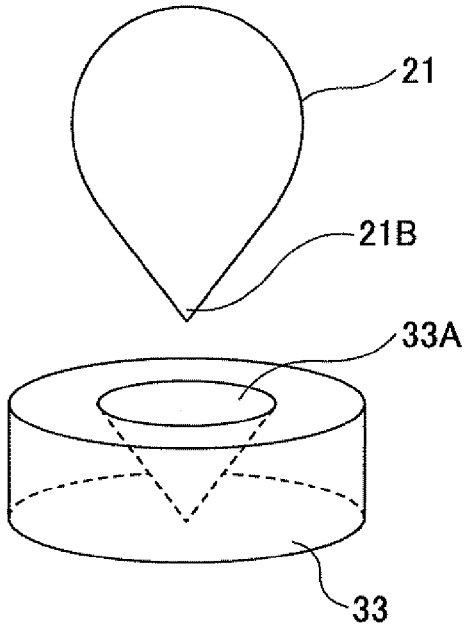
FIG. 3A is an exploded drawing of an antenna apparatus according to a third embodiment shown in perspective view.

FIG. 3A is an exploded drawing of an antenna apparatus according to a third embodiment shown in perspective view.

Figure 3B:
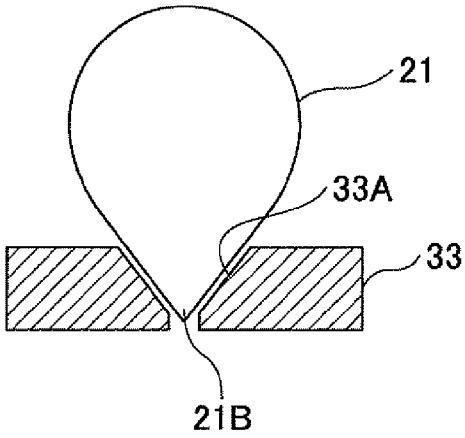
FIG. 3B is a schematic drawing showing a cross sectional view of a main portion of the antenna apparatus according to the third embodiment.
Figure 3C:
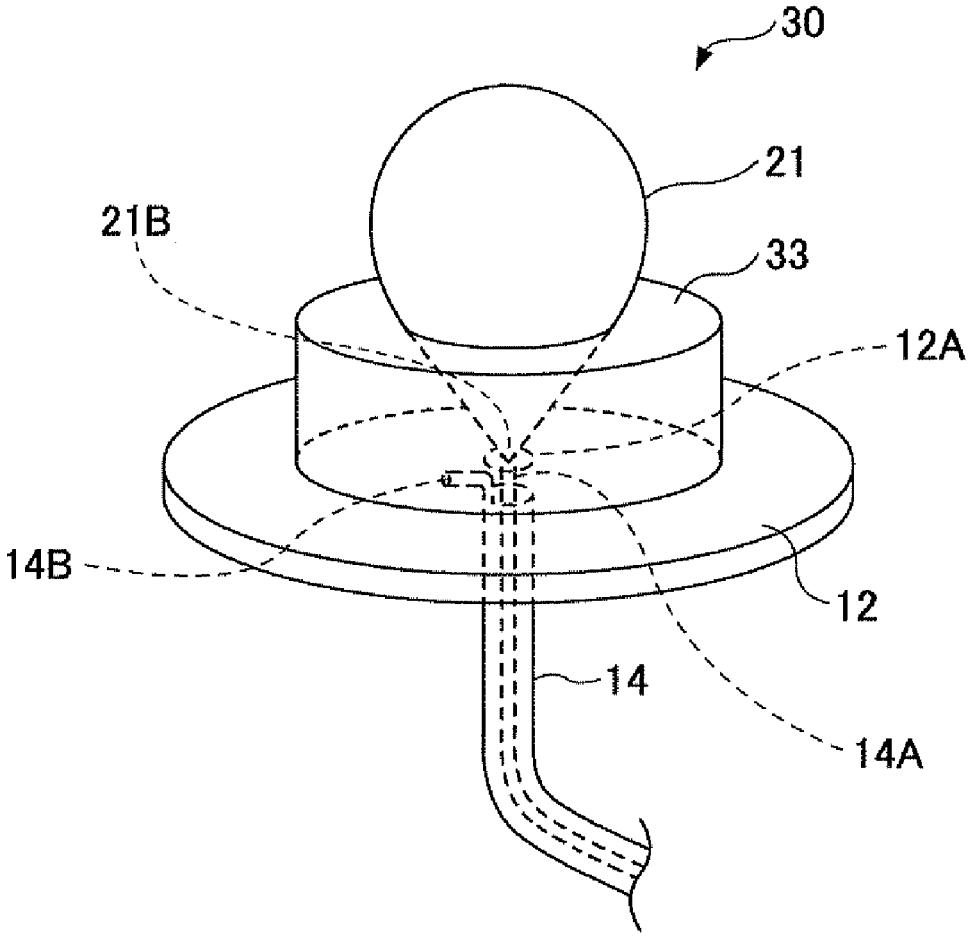
FIG. 3C is a schematic drawing of the antenna apparatus according to the third embodiment shown in perspective view.

FIG. 3B is a schematic drawing showing a cross sectional view of a main portion of the antenna apparatus according to the third embodiment. FIG. 3C is a schematic drawing of the antenna apparatus according to the third embodiment shown in perspective view.

An antenna apparatus 30 includes the antenna element 21 having the inverted teardrop shape, the ground element 12 having the disk shape, and a holder 33.

The antenna apparatus 30 according to the third embodiment is different from the antenna apparatus 20 according to the second embodiment in that a holder 33 is not formed to hold the whole surface of the antenna element 21.

Hereinafter, the same elements as or similar elements to those of the antenna apparatus 20 according to the second embodiment are referred to by the same reference numerals, and a description thereof is omitted.

As shown in FIGS. 3A to 3C, the holder 33 is bonded on the upper surface of the ground element 12 and holds the antenna element 21 against the ground element 12. The holder 33 constitutes a holding member. The holder 33 is formed of molded resin, and is formed so that the holder 33 holds a surface of a conical portion of the antenna element 21 except for the feeding portion 21B. The holder 33 is shaped into an annular shape which has a conical-shaped opening 33A. The surface of the conical-shaped opening 33A is formed to fit the surface of the conical portion of the antenna element 21. The conical portion of the antenna element 21 may be bonded onto the surface of the conical-shaped opening 33A. The holder 33 constitutes a holding member.

The antenna apparatus 30 is assembled by bonding the holder 33 onto the upper surface of the ground element 12 in a state that the cable core 14A is connected to the feeding portion 21B via the conical-shaped opening 33A. The antenna element 21 is insulated from the ground element 12.

The antenna apparatus 30 including the antenna element 21 having the inverted teardrop shape as described above provides a VSWR value of about 2.0 to about 3.0 within the frequency band from about 3.0 GHz to about 20.0 GHz. The antenna apparatus 30 is suitable for UWB communication. The antenna apparatus 30 provides directivity which is uniform in 360 degrees, because the antenna apparatus 30 has a uniform shape in plane view. The antenna apparatus 30 provides a high quality UWB communication.

Thus, the third embodiment of the present invention can provide the antenna apparatus 30 which is used in UWB communication with a high performance, and which can be assembled easily at a low cost, and which provides sufficient joint strength between the antenna element 21 and the ground element 12.

The present invention is not limited to these embodiments, but variations and modifications may be made without departing from the scope of the present invention.

The present application is based on Japanese Priority Application No. 2008-235020 filed on Sep. 12, 2008 with the Japanese Patent Office, the entire contents of which are hereby incorporated by reference.

What is claimed is:

1. An antenna apparatus comprising:

an antenna element having an inverted teardrop shape and configured to be fed with electrical power from an external power source;

a ground element; and a holding member made of an insulating material, configured to cover the entire antenna element and hold the antenna element against the ground element so as to insulate the antenna element from the ground element.

2. The antenna apparatus as claimed in claim 1, wherein the antenna element includes a bore formed on the top portion of the inverted teardrop shape, and wherein the holding member is formed into an inverted cup shape configured to include an opening formed on the top thereof, and holds the top portion of the antenna element by engaging an engaging member into the bore through the opening.

3. The antenna apparatus as claimed in claim 1, wherein the holding member is formed of molded resin so as to include the antenna element.

4. An antenna apparatus comprising:

an antenna element having an inverted teardrop shape and configured to be fed with electrical power from an external power source;

a ground element; and holding means for covering and holding the entire antenna element against the ground element so as to insulate the antenna element from the ground element.

5. The antenna apparatus as claimed in claim 4, wherein the antenna element includes a bore formed on the top portion of the inverted teardrop shape, and wherein the holding means is formed into an inverted cup shape configured to include an opening formed on the top thereof, and holds the top portion of the antenna element by engaging an engaging member into the bore through the opening.

* * * * *